US006079050A

United States Patent [19]

Hooper-Jackson

[11] Patent Number: 6,079,050

[45] Date of Patent: Jun. 27, 2000

[54] INNER THIGH PROTECTOR GARMENT

[76] Inventor: Kim Hooper-Jackson, 6008 Bee Ct., Elkridge, Md. 21075

[21] Appl. No.: 09/320,531

[22] Filed: May 26, 1999

Related U.S. Application Data

[60] Provisional application No. 60/090,865, Jun. 26, 1998.

[51] Int. Cl.[7] ..... A41B 9/12

[52] U.S. Cl. ..... 2/78.1; 450/153; 450/142

[58] Field of Search ..... 2/215, 401, 400, 2/409, 228, 239, 337, 267, 406, 78.1, 22, 23, 24, 61, 62, 227; 450/100, 142, 101, 153, 122, 97, 98, 109, 112, 143, 149, 151; D2/712

[56] References Cited

U.S. PATENT DOCUMENTS

| | | | |
|---|---|---|---|
| 1,587,576 | 6/1926 | Beck | 2/224 |
| 2,093,371 | 9/1937 | Sheehy | 2/224 |
| 2,305,736 | 12/1942 | Rhea | 128/149 |
| 2,318,199 | 5/1943 | Clements | 2/224 |
| 2,323,451 | 7/1943 | Bullinger | 128/149 |
| 2,381,816 | 8/1945 | Frieman | 2/224 |
| 2,440,021 | 4/1948 | Rosenblatt | 128/149 |
| 2,674,997 | 4/1954 | Haas | 128/149 |
| 2,831,486 | 4/1958 | Sanders | 128/289 |
| 3,990,440 | 11/1976 | Gaylord, Jr. | 128/892 |
| 4,700,407 | 10/1987 | Mattila | 2/465 |
| 4,999,854 | 3/1991 | Fell | 2/409 |

*Primary Examiner*—John J. Calvert
*Assistant Examiner*—Alissa L. Hoey
*Attorney, Agent, or Firm*—Milde, Hoffberg & Macklin, LLP

[57] ABSTRACT

A pair of substantially identical garments are adapted to be worn on each upper thigh to protect the thighs against irritation due to friction when they are rubbed together during walking, running, exercising, etc. The garment comprises a tube of elastomeric cloth material having an upper end and a lower end. The upper end has a larger diameter than the lower end. The length of the garment along its central axis between the upper and lower end is less than approximately eleven inches and is preferably in the range of six to ten inches. Either the garment or separate pantyhose or underwear can be provided with padding between the inner thighs to further protect against skin irritation due to friction when the thighs rub against each other.

11 Claims, 3 Drawing Sheets

FIG.3
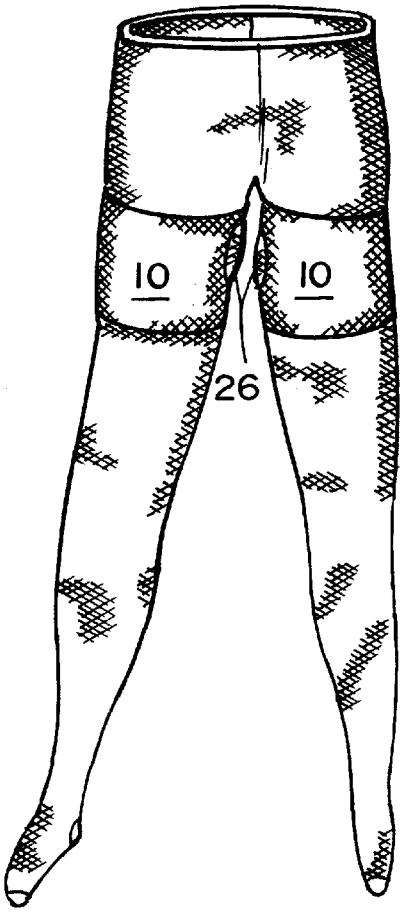
FIG.4
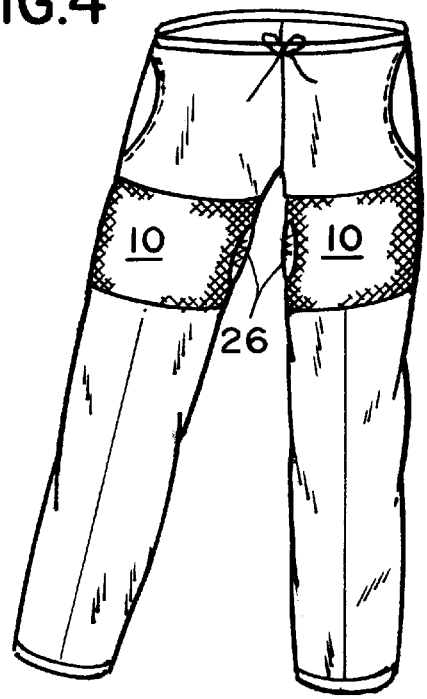
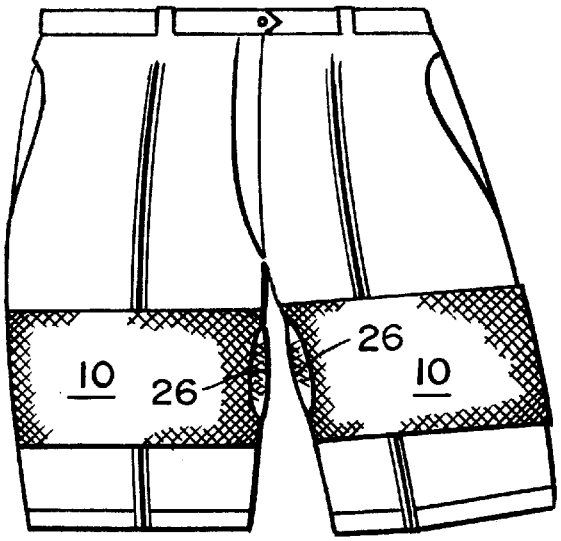
FIG.5

INNER THIGH PROTECTOR GARMENT

CROSS REFERENCE TO RELATED APPLICATION

This application is related to and claims priority from prior provisional patent application Ser. No. 60/090,865, filed Jun. 26, 1998.

BACKGROUND OF THE INVENTION

The present invention relates to a protective garment and padding for human inner thighs; in particular, a garment which is designed to be worn on the upper portion of each leg or thigh of a person to protect against irritation due to friction between the inner thighs.

Many people, particularly women and teenage girls whose extra weight is concentrated in the thigh area, experience discomfort in the region between the thighs due to friction when the inner thighs rub against each other while walking, running and exercising. Such friction leads to skin irritation, especially during warm weather, often resulting in a severe rash or at least redness of the skin and consequent discomfort between the thighs.

Another problem, which particularly affects women who wear girdles in the lower abdomen and thigh area, is an embarrassing "swishing" sound that is produced when the thighs rub together while walking.

Finally, another problem which often occurs with persons wearing pants or shorts is that the leg portions of the pants "ride up" toward the lower abdomen or down toward the legs, due to the friction between the thighs as well as to excess fat on the upper outer thighs (i.e., "saddle bags").

SUMMARY OF THE INVENTION

It is a principal object of the present invention to provide a remedy for the various problems caused when a person's thighs rub together during walking, running, exercising, etc.

This object, as well as other objects which will become apparent from the discussion that follows, are achieved, according to the present invention, by providing a garment, to be worn individually one on each thigh, which ameliorates the friction and chaffing between the thighs as they are rubbed together.

In particular, the garment comprises a tube of elastomeric cloth material having an upper end and a lower end, the upper end having a larger diameter than the lower end. The length of the garment along its central axis between the upper and the lower end is less than approximately eleven inches and is preferably in the range of six to ten inches.

The garment is adapted and designed to be worn as high up on a person's leg as possible; that is, on the upper thigh. When two such garments are worn in this way, they reduce substantially the friction in the region between the upper thighs when the person is walking, running, exercising, etc.

Advantageously, the garment has a hem surrounding both the upper end and the lower end thereof to provide reinforcement and stability at these ends.

The elastomeric cloth material is preferably of the type which permits the passage of air and moisture therethrough. The "no roll elastic" is preferably used at the upper and lower ends of the garment to prevent the garment from rolling either up or down. Cotton spandex and nylon spandex are the materials of choice; however, other materials may be used provided that the cloth material is a "mesh" spandex or the like which can "breath" through the plurality of holes.

In order to further guard against friction and chaffing, the garment preferably also includes a protective pad disposed on the cloth tube substantially mid-way between the upper and lower ends. This protective pad is advantageously oval shaped and is disposed on the tube with its major axis extending substantially parallel to the central axis of the tube. When two garments are worn properly, the pad on each garment further guards against friction and chaffing in the region between the upper thighs.

Alternatively, or in addition to the protective pad, the garment may be provided with a cloth overlay disposed on the tube substantially midway between the upper and lower ends to reduce friction between two garments when they are used. The cloth overlay is preferably made of a smooth material, such as satin, to minimize friction when the two garments are rubbed together during walking, running, exercising, etc., and to provide comfort as well as minimize "saddle bags".

Instead of providing a tubular garment with its associated padding, it is possible to apply the protective pads to a pants-type garment such as pantyhose or underpants. In this case, a protective pad is disposed on each tubular portion of the garment in the region between the upper thighs such that the pads are disposed directly opposite each other when the garment is worn.

For a full understanding of the present invention, reference should now be made to the following detailed description of the preferred embodiments of the invention as illustrated in the accompanying drawings.

BRIEF DESCRIPTION OF THE DRAWINGS

FIG. 3 is an elevational view of the thigh protector according to the invention beneath a pair of pantyhose.

FIG. 4 is an elevational view of the thigh protector according to the present invention beneath a pair of jogging pants.

FIG. 5 is an elevational view of the thigh protector according to the present invention beneath a pair of Bermuda shorts.

DESCRIPTION OF THE PREFERRED EMBODIMENTS

Figure 1:
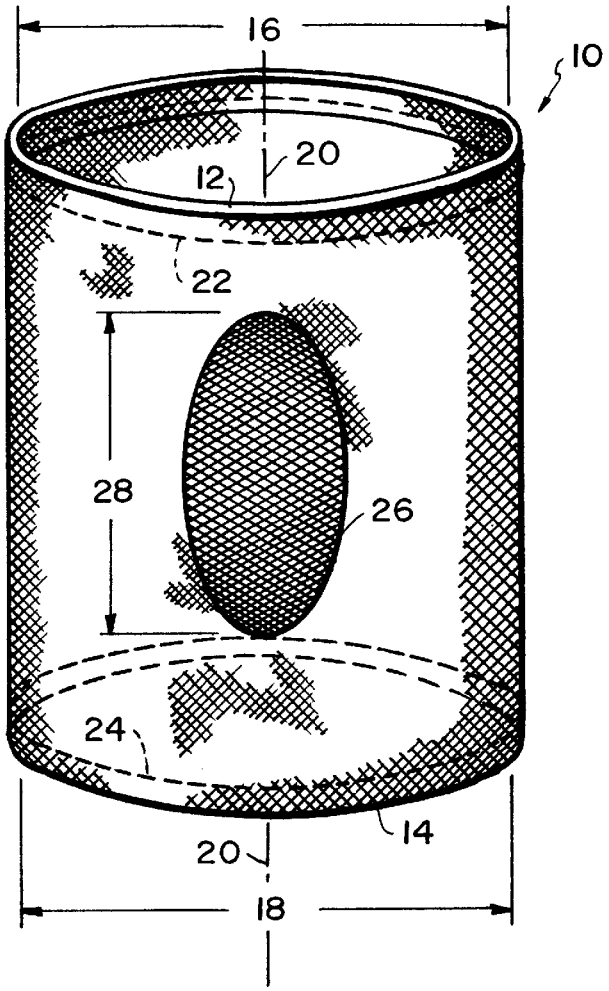
FIG. 1 is a side elevational view of a preferred embodiment of the thigh protector garment according to the present invention.

The preferred embodiments of the present invention will now be described with reference to FIGS. 1–5 of the drawings. Identical elements in the various figures are identified with the same reference numerals.

FIG. 1 illustrates the garment 10 according to the present invention. As may be seen the garment is in the shape of a tube having an upper end 12 and a lower end 14. The upper end 12 has a diameter 16 which is larger than the diameter 18 of the lower end 14. The length of the tube-like garment 10 along its central axis 20 between the upper end and the lower end is less than approximately eleven inches and is preferably in the range of six to ten inches.

The garment 10 has a reinforced hem 22 surrounding the upper end 12 and a reinforced hem 24 surrounding the lower end 14 to prevent fraying, etc., during use.

The tube 10 is made of an elastomeric cloth material such as cotton spandex, nylon spandex or "no roll elastic". To facilitate "breathing", the material, no matter what it is made of, may be a mesh spandex.

Arranged on one side the tube-like garment, either on the inside or outside of the tube, is a protective pad 26 disposed substantially midway between the upper end and the lower end. The pad is approximately oval shaped and is disposed on the tube with its major axis 28 extending substantially in parallel with the central axis 20 of the tube.

In addition, or alternatively, the garment may be provided with a cloth overlay essentially of the same pattern as the pad 26. Whereas the pad protects against the effects of friction when two garments, worn on a person's thighs, rub together, the overlay is intended to reduce friction between the two garments as well as to provide comfort. Thus, the cloth overlay is made of a smooth material such as satin.

Figure 2:
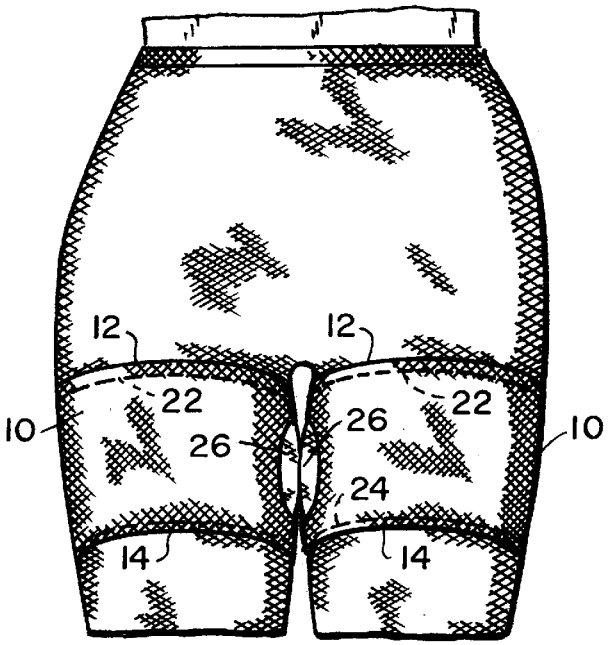
FIG. 2 is a side elevational view showing the thigh protector garment of FIG. 1, arranged in its proper position on a person's thigh.

FIG. 2 illustrates two garments being worn on the upper thighs of a person. The garments are arranged such that the pads and/or cloth overlays 26 are facing each other in the region of greatest friction. The upper ends 12 of the two garments are pulled up on the thighs as high as they will go.

FIG. 3 illustrates how the garment according to the present invention may be worn by a woman with pantyhose. The garments 10 are placed on the upper thighs either inside or outside of the pantyhose.

FIGS. 4 and 5 illustrate how the garment 10 according to the present invention may be worn with jogging pants or Bermuda shorts, respectively. In this case, the garment 10 is worn underneath the pants or shorts to avoid an unsightly appearance. Experience has shown that the use of the garment 10 is helpful in preventing the pants or shorts from "riding up" due to friction between the legs.

Figure 6:
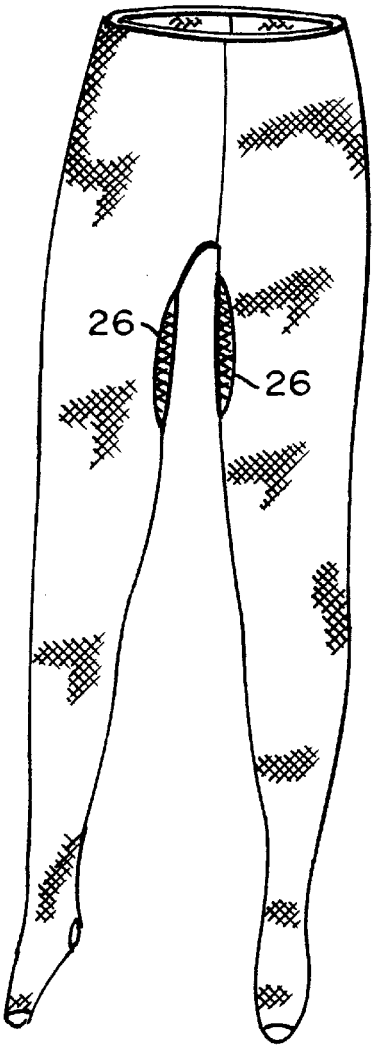
FIG. 6 is an elevational view of pantyhose with inner thigh protector pads according to the present invention.
Figure 7:
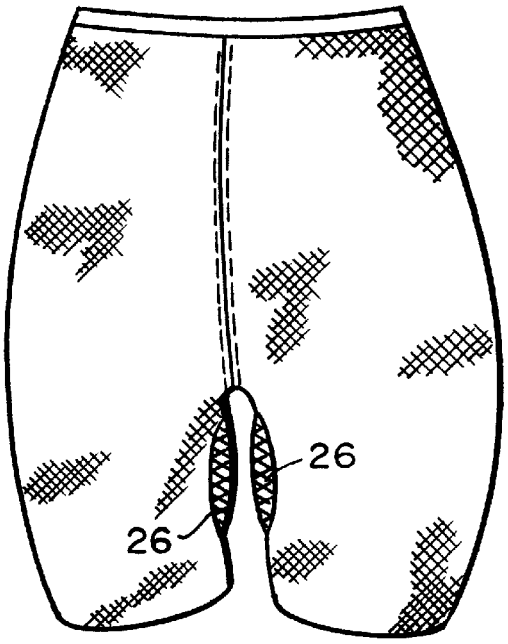
FIG. 7 is an elevational view of an undergarment with thigh protector pads according to the present invention.

FIGS. 6 and 7 illustrate how thigh protector pads of the type shown in FIGS. 1 and 2 can be attached directly to pantyhose (FIG. 6) and underwear (FIG. 7). The thigh protector pads 26 may be attached either by sewing or by an adhesive either to the inside or outside of the garment. These pads protect against skin irritation due to friction when the thighs rub against each other while walking, running and exercising.

There has thus been shown and described a novel inner thigh protector garment which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A garment adapted to be used in a pair of substantially identical garments which are worn on each upper thigh of a human being to protect said thighs, or portions of an undergarment worn over said thighs, from rubbing together, said garment comprising:

(a) a tube of elastomeric cloth material having an upper ends a lower end and a central axis therebetween, said upper end having a larger diameter than said lower end, said central axis having a length between said upper end and lower end of less than approximately eleven inches;

(b) a cloth overlay disposed on each tube substantially midway between said upper end and said lower end thereof to reduce friction between two garments which are worn on a pair of legs and caused to rub together.

2. The garment defined in claim 1, further comprising a reinforced hem surrounding said upper end and said lower end thereof.

3. The garment defined in claim 1, wherein said elastomeric cloth material is cotton spandex.

4. The garment defined in claim 1, wherein said elastomeric cloth material is nylon spandex.

5. The garment defined in claim 1, wherein said elastomeric cloth material is a mesh spandex.

6. The garment defined in claim 1, wherein said elastomeric cloth material includes a "no roll elastic".

7. The garment defined in claim 1, wherein said cloth overlay includes a protective pad disposed on said tube substantially midway between said upper end and said lower end to reduce chafing in an upper thigh region.

8. The garment defined in claim 7, wherein said protective pad is substantially oval shaped with a major axis and a minor axis, said pad being disposed on said tube with its major axis extending substantially in parallel with the central axis of said tube.

9. The garment defined in claim 1, wherein said cloth overlay is made of smooth material.

10. The garment defined in claim 9, wherein said smooth material is selected from a group consisting of satin and nylon.

11. The garment defined in claim 1, wherein said length is in a range of 6 to 10 inches.

* * * * *